US005127112A

United States Patent [19]

Brock

[11] Patent Number: 5,127,112

[45] Date of Patent: Jul. 7, 1992

[54] UNDERWATER BURIAL CAPSULE

[76] Inventor: Richard S. Brock, 909 Seattle St., Kent, Wash. 98031

[21] Appl. No.: 370,758

[22] Filed: Jun. 23, 1989

[51] Int. Cl.[5] ..... A61G 17/08

[52] U.S. Cl. ..... 27/1; 27/2; 27/35

[58] Field of Search ..... 27/2, 4, 7, 19, 35, 27/1

[56] References Cited

U.S. PATENT DOCUMENTS 3,732,602 5/1973 Vigh ..... 27/1

*Primary Examiner*—Richard E. Chilcot, Jr.
*Attorney, Agent, or Firm*—John P. Halvonik

[57] ABSTRACT

A method and apparatus that provides for underground burial in an enclosed air, and water-tight capsule filled with a preservative gas or liquid. The burial chamber provides a method of keeping a corpse in a freshly preserved state at the bottom of bodies of water. The result is a saving on the usage of vital land space.

9 Claims, 1 Drawing Sheet

UNDERWATER BURIAL CAPSULE

BACKGROUND OF THE INVENTION

1. Field of the Invention

The invention relates to the field of burial methods and, in particular, to a specific method of burying a corpse in an elliptical burial chamber filled with preservative gases and/or liquids and a capsule to achieve this purpose.

2. Prior Art

While burial at sea has long been known as the common method of disposing of the remains of deceased sailors and other maritime passengers, the present invention provides a more permanent place of rest for the corpse of the deceased. More recently, a U.S. Pat. No. 3,732,602 has proposed that cremated remains be buried under the sea in an urn. However, none have yet proposed that the ramins of the deceased be stored underwater in a state of high preservation. Storage underwater would be more desirable than on land since it is important that land be efficiently used.

SUMMARY OF THE INVENTION

The present invention provides for underwater burial in an enclosed, air and water-tight capsule filled with a preservative gas or liquid. The burial chamber provides individuals with a changer for a new life after death if medical science discovers new ways to give life to the corpse or by genetic methods e.g. cloning. The corpse may be wrapped in an air-tight shroud of plastic or fibertarp. After the capsule is lowered into the sea, the position is marked for the benefit of relatives and for future medical practitioners.

One of the objects of the invention is to provide a burial method that does not tie up the use of dry land.

Another objcect is to provide a burial method that does not interfere with the natural enviroment of the sea or land.

Another object is to provide a burial method that offer a choice in the method of burial.

Yet another objective is to provide a type of burial service that is based on the symbolism of uniting a burial capsule with a body of water.

Still another objective is to provide a method of burying a corpses at the bottom of bodies of water.

Another is to provide a burial capsule of keeping the corpse in a freshly preserved state.

Still another is to provide a capsule that provides a place for storing possessions.

Another is to provide a method of storing corpses for future use by science.

Other objects will become known once the invention is described.

1. A pure core of oil for pressure and preservation.
2. Inner precast fiberglass capsule with molded male and famale halves.
3. Glass-reinforced cement 6' to 2" thick (male and famale halves).
4. Fiberglass fasteners for the bottom half of the fiber tarp; 2 pieces per support point.
5. Fiber glass rod for reinforcement and tie down for top half of the fiber tarp. This is to contain the cadaver. Rod extends at each end.

Figure 2:
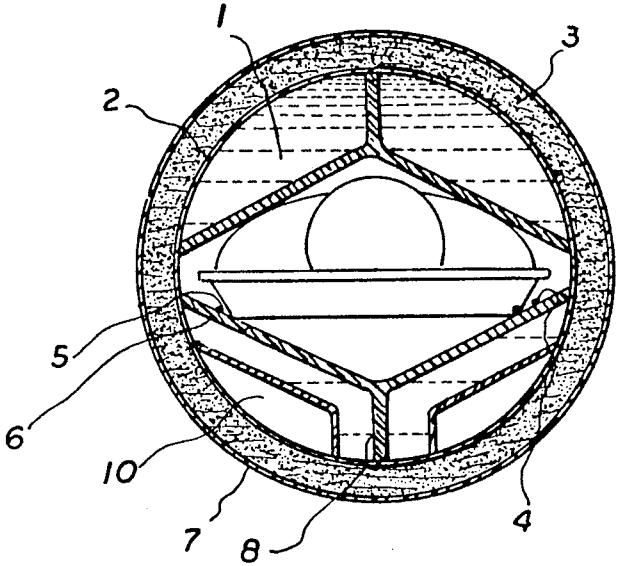
Figure 1:
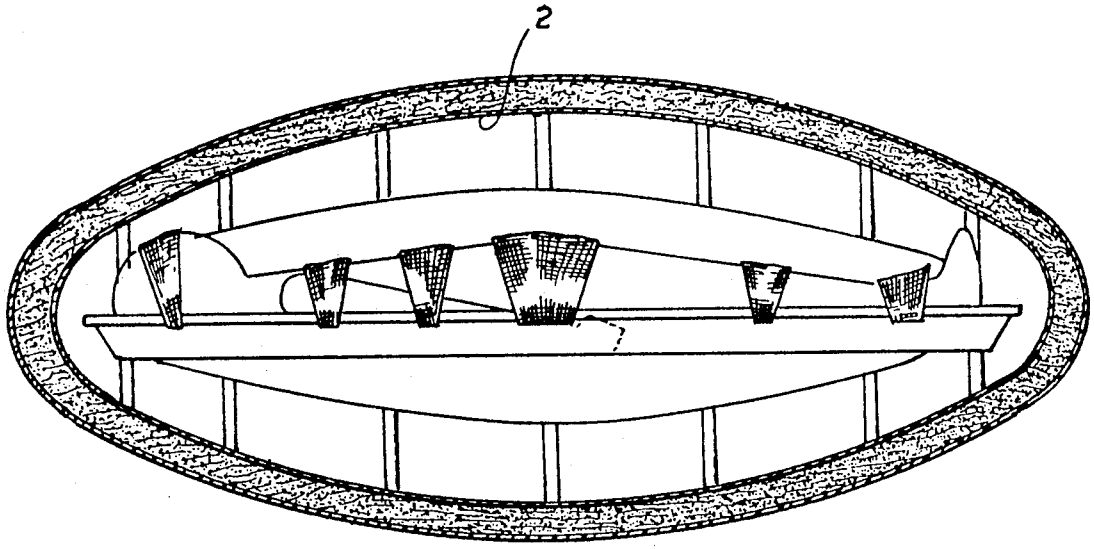
FIG. 1 shows a cross section of the capsule with the following numbered figures.

6. The same glass rod to tie down the bottom tarp at the intermediate spaced intervals.
7. Outer, precast, fiber glass capsule-molded male and female halves (marine) lengthwise.
8. Fiberglass precast supports inner strength 5 to 6 times as needed to suit.
9. Epoxy all fitted points and lines.
10. Compartments FIG. 2 shows a front view of the capsule.

DESCRIPTION OF THE INVENTION

This is a unique burial at sea. This sea capsule in which houses a deceased loved one was an individual who, when still with us, possibly looked into this system of burial.

The shell would preferably be made of a glass-reinforced cement inner and outer precast fiber glass shells. Preferably the cement will be of thickness 6 to 12 inches. It would probably be easiest to mold each cement halve separately and to join it to the corresponding halve through use of the male/female connections placed along the rim of the halves where they will be joined. Additionally, the halves should be sealed with an epoxy or other sealant that will render the halves water-tight.

It will be apparent that other methods of constructing the shells can be employed. Similarly, other materials can be used, those suggested are considered the best. Any other methods of construction can be employed provided that they construct a capsule that will remain structurally rigid for long periods of time underwater and will not be subject to rupture caused by the pressure of the water and not be subjet to corrosion or deterioration.

It is belived that an ellipsoid capsule structure with reinforcing fiberglass members in the interior will offer the strongest suitable structure. Metals should be avoided as these can decay through electrolysis with the water. The interior of the capsule contains the corpse wrapped in a plastic, gas-tight shroud. Other wrapping materials could suffice provided that the cadaver and the shroud are leakproof and non-reactive against preservative chemicals or gases. Oil can be used as one of the preservatives as well as non-reactive gases.

The interior can contain a liquid or gaseous preservative. This may be oil or other liquid capable of preserving the corpse for a long time. The liquids are placed in the capsule after the body is wrapped and placed in the capsule. Any suitable methods that accomplish this are possible, for example: liquid can be injected into the bottom of the capsule to insure that air or other gas is not trapped inside.

There would be a recorded chart showing the location of the burial site. This is necessary for the recovery of the capsule for use in advanced scientific studieds, etc. This may also come with a record of localized information regarding autobiography and genealogy of individuals. A corresponding service may also be performed in conjuction with the burial at sea.

I claim:

1. A method of preserving corpses in a freshly preserved state for long periods of time comprising the following:

(a) placing the corpse inside a heavier-than-water, rigid capsule capable of withstanding great pressure and maintaining a corpse preservative within the confines of said capsule, (b) filling the capsule with a preservative liquid, (c) sealing the capsule so as to make it liquid impervious, (d) lowering the encapsulated corpse to the bottom of a body of water, (e) marking the location of the capsule.

2. The method of claim 1 where step (a) comprises placing the corpse on a half portion of the capsule which is then joined to another half portion of the capsule through the use of male and female connections.

3. The method of claim 2 where step (c) comprises sealing the capsule with an epoxy.

4. The method of claim 3 wherein the corpse is first wrapped in a gas impervious sheet.

5. A method of preserving corpses in a freshly preserved state for long periods of time comprising the following:

(a) placing the corpse inside a heavier-than-water, rigid capsule capable of withstanding great pressure and maintaining a corpse preservative within the confines of said capsule, (b) filling the capsule with a preservative gas, (c) sealing the capsule so as to make it liquid impervious, (d) lowering the encapsulated corpsed to the bottom of a body of water, (e) marking the location of the capsule.

6. The method of claim 5 where step (a) comprises placing the corpse on a half portion of the capsule which is then joined to another half portion of the capsule through the use of male and female connections.

7. The method of claim 6 where step (c) comprises sealing the capsule with an epoxy.

8. The method of claim 7 wherein the corpse is first wrapped in a gas impervious sheet.

9. An apparatus for the preservation of corpses comprising: an ellipsoid concrete shell reinforced with fiberglass, said shell substantially impervious to water, said shell capable of maintaining structural rigidity member under large amounts of water, said shell capable of maintaining within the confines of said shell a fluid, corpse preservative.

* * * * *